US008278612B2

(12) United States Patent
Firor

(10) Patent No.: US 8,278,612 B2
(45) Date of Patent: Oct. 2, 2012

(54) AERODYNAMIC FIN LOCK FOR ADJUSTABLE AND DEPLOYABLE FIN

(75) Inventor: Randall S. Firor, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 192 days.

(21) Appl. No.: 12/844,236

(22) Filed: Jul. 27, 2010

(65) Prior Publication Data

US 2012/0025010 A1 Feb. 2, 2012

(51) Int. Cl.
*F42B 15/01* (2006.01)

(52) U.S. Cl. ..... 244/3.27; 244/3.24; 244/3.28

(58) Field of Classification Search ..... 244/3.24, 244/3.27, 3.28, 3.29, 3.3
See application file for complete search history.

(56) References Cited

U.S. PATENT DOCUMENTS 3,697,019 A 10/1972 Watson
3,976,266 A 8/1976 Fieuzal et al.
6,152,041 A 11/2000 Harris et al.

OTHER PUBLICATIONS

"International Application Serial No. PCT/US2011/000956, Search Report mailed Oct. 3, 2011", 2 pgs.
"International Application Serial No. PCT/US2011/000956, Written Opinion mailed Oct. 3, 2011", 3 pgs.

*Primary Examiner* — Tien Dinh
*Assistant Examiner* — Nicholas McFall
(74) *Attorney, Agent, or Firm* — Schwegman Lundberg & Woessner, P.A.

(57) ABSTRACT

Some embodiments pertain to a projectile that includes a body and a support attached to the body. The projectile further includes at least one partial fin that is rotatably attached to the support such that the partial fin moves between a stowed position and a deployed position. The support moves relative to the partial fin as the partial fin moves between the stowed position and the deployed position such that the partial fin and the support form a complete fin when the partial fin is in the deployed position. The support may form a portion of the front edge of the complete fin when the partial fin is in the deployed position. The support may lock the partial fin in place when the partial fin is in the deployed position.

12 Claims, 6 Drawing Sheets

AERODYNAMIC FIN LOCK FOR ADJUSTABLE AND DEPLOYABLE FIN

TECHNICAL FIELD

Embodiments pertain to a projectile that includes fins, and more particularly to a projectile that includes fins which are capable of moving from a stowed position to a deployed position.

BACKGROUND

The tail fins on existing projectiles cause a significant percentage of the overall aerodynamic drag on the projectiles during flight. Some of the current tail fin designs are adapted to move the fins from a stored position to a deployed position. The structures that are associated with moving the fins from a stored position to a deployed position are usually a large source of separated or re-circulated air flow around the fins (i.e., unwanted drag).

Another drawback with existing tail fin designs is that the locking mechanism often fails to capture the fin in the deployed position in certain environments. In addition, there is commonly excessive free play within the fin when the fin is in a locked and deployed position.

The drawbacks that are associated with the existing structures which move the fins from a stored position to a deployed position could be overcome by developing a fin that does not generate undesirable air flow when the fin is in the deployed condition. Reducing undesirable air flow over the tail fin would dramatically reduce the drag of the tail and increase the overall range of the vehicle. It would also be desirable if the fins were able to lock securely in the deployed position in any environment that the projectile might be exposed to during use.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

As used herein, fins are meant to include any surface that generates aerodynamic forces and/or moments. Some example terms for such surfaces include tail, fin, wing, strake or canard (among others).

As used herein, projectile refers to missiles, guided projectiles, unguided projectiles and sub-munitions.

Figure 1:
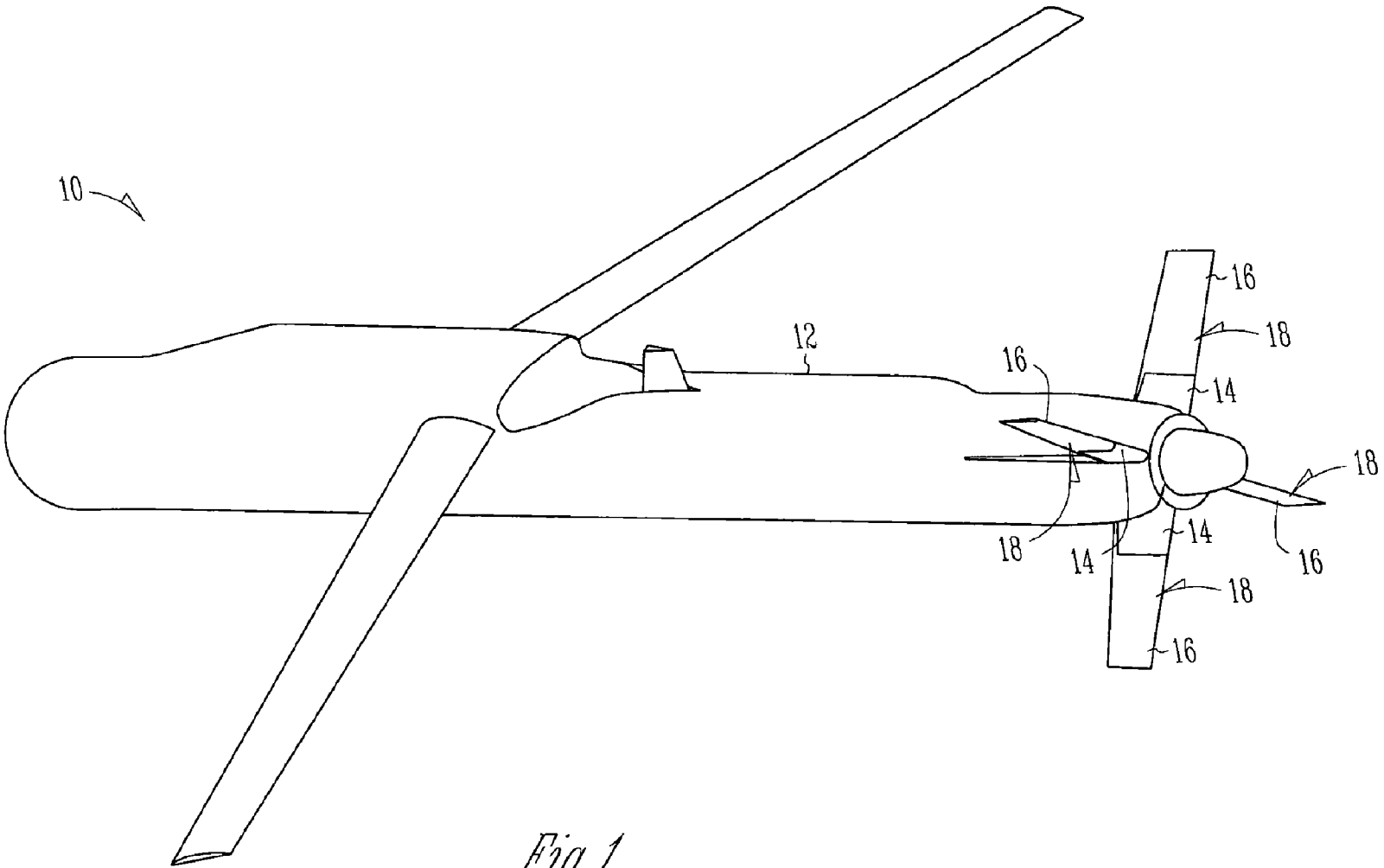
FIG. 1 is a perspective view of an example projectile that includes partial tail fins.
Figure 2:
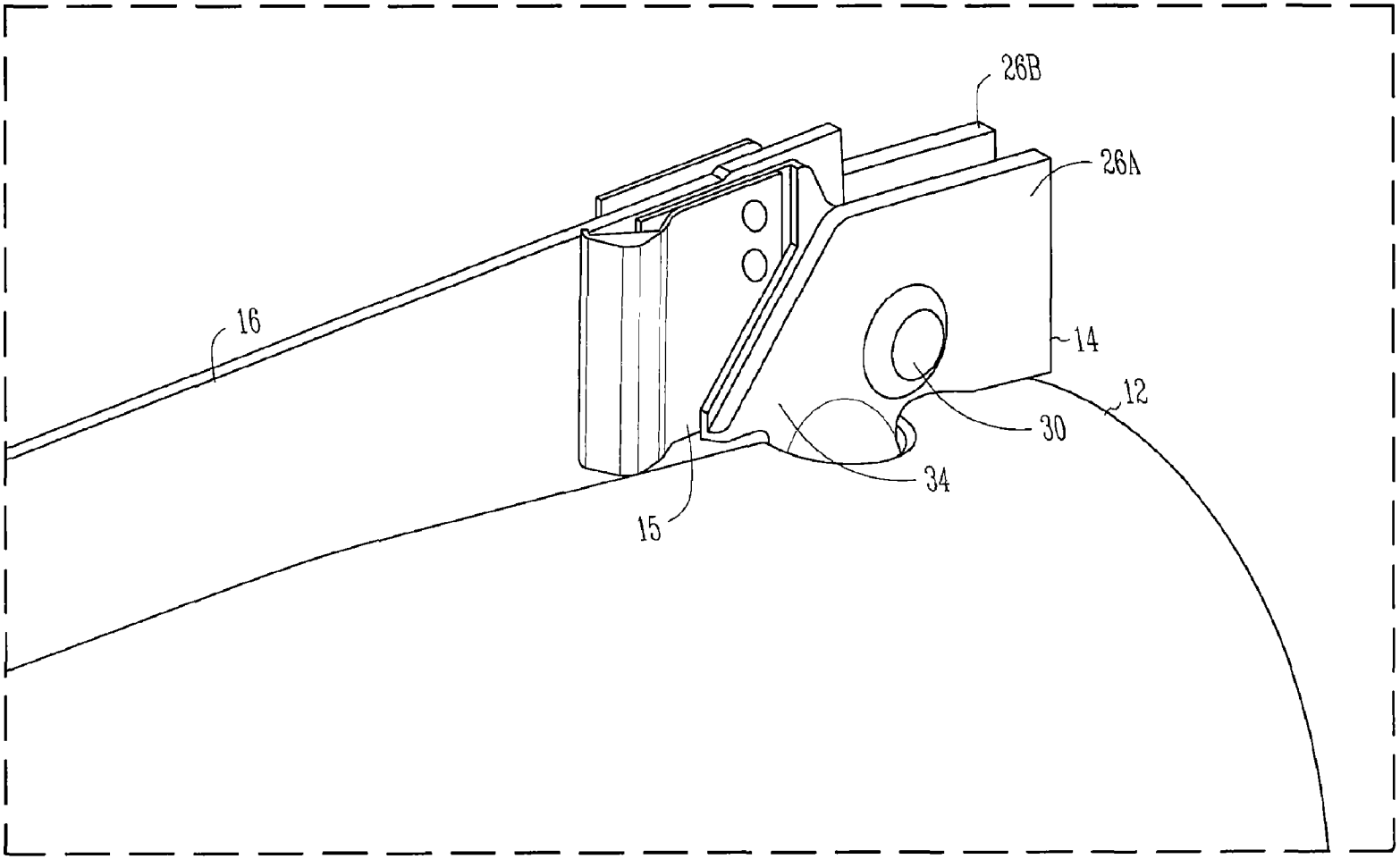
FIG. 2 is an enlarged perspective view illustrating a portion of the projectile shown in FIG. 1 with one of the partial tail fins in a stowed position.
Figure 3:
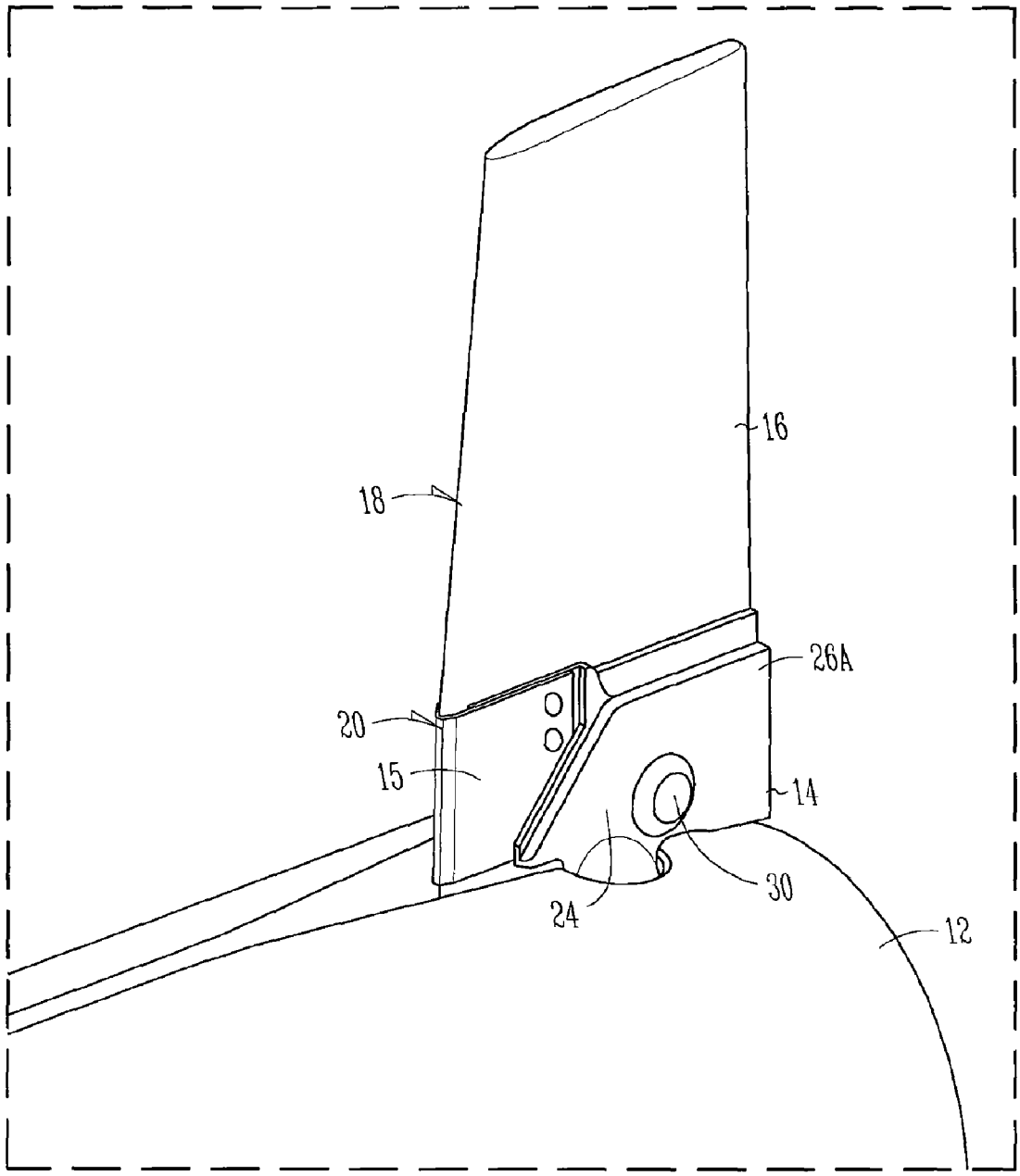
FIG. 3 is an enlarged perspective view similar to FIG. 2 illustrating a portion of the projectile shown in FIG. 1 with the partial tail fin in a deployed position.
Figure 4:
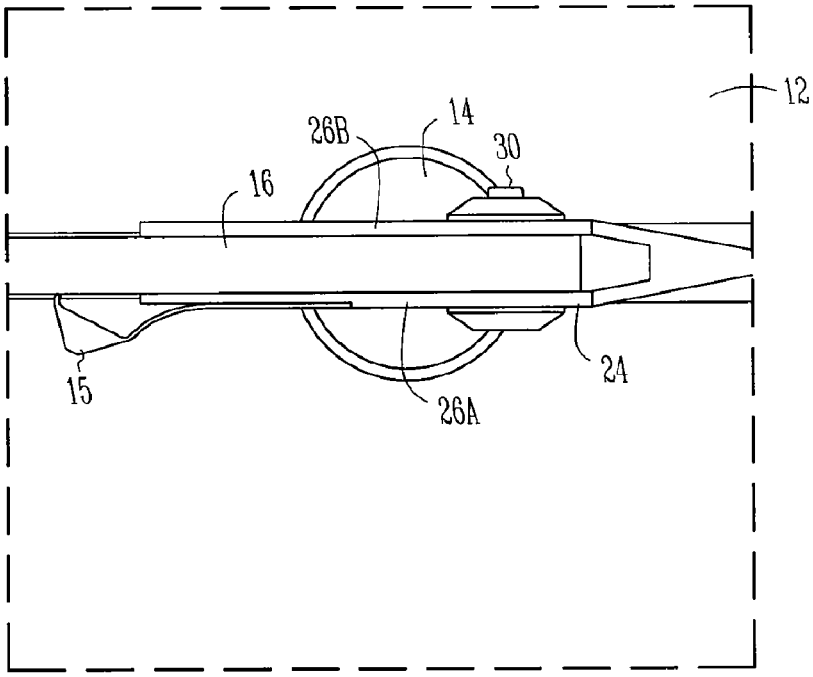
FIG. 4 is a plan view of the rear of the projectile shown in FIG. 2 with the partial tail fin in a stowed position.
Figure 5:
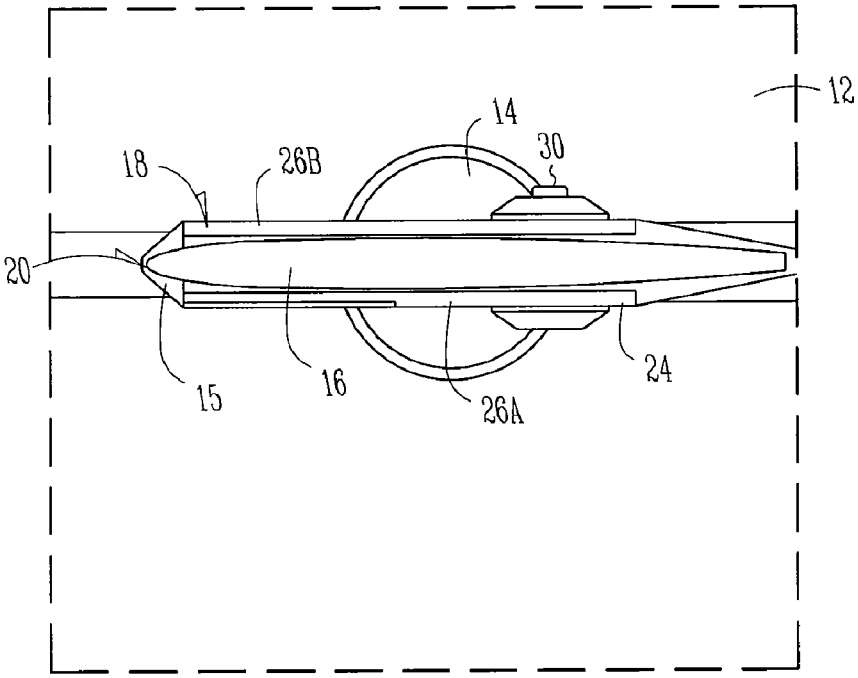
FIG. 5 is a plan view of the rear of the projectile shown in FIG. 3 with the partial tail fin in a deployed position.

FIGS. 1-6 illustrate an example projectile 10. The projectile 10 includes a body 12 and a support 14 attached to the body 12. The projectile 10 includes at least one partial fin 16 that is rotatably attached to the support 14 such that the partial fin 16 moves between a stowed position (FIGS. 2, 4 and 6) and a deployed position (FIGS. 1, 3 and 5). The support 14 moves relative to the partial fin 16 as the partial fin 16 moves between the stowed position and the deployed position such that the partial fin 16 and the support 14 form a complete fin 18 when the partial fin 16 is in the deployed position. The partial fins 16 are typically in the stowed position until the projectile 10 receives a command to move the partial fins 16 to the deployed position.

In the illustrated example embodiments, the support 14 forms a portion of the front edge 20 of the complete fin 18 when the partial fin 16 is in the deployed position (FIGS. 1, 3 and 5). It should be noted that while the illustrated support 14 forms a portion of the front edge 20 of the complete fin 18 when the partial fin 16 is in the deployed position, embodiments are contemplated where the support 14 forms other portions of the complete fin 18 when the partial fin 16 is in the deployed position.

As shown most clearly in FIG. 3, the support 14 locks the partial fin 16 in place when the partial fin 16 is in the deployed position. The support 14 is less easily fouled by ice or debris than conventional locking mechanisms, especially when the projectile 10 is used in relatively harsh environments.

In the illustrated example embodiments, the support 14 includes a leaf spring 15 that is (i) biased against the partial fin 16 when the partial fin 16 is in the stowed position (FIGS. 2 and 4); and (ii) forms a portion of the front edge 20 of the complete fin 18 when the partial fin 16 is in the deployed position (FIGS. 3 and 5). The leaf spring 15 provides vibration dampening to help reduce the effects of any vibrations that are generated on the partial fin 16 during flight of the projectile 10. As shown in FIG. 3, the leaf spring 15 locks the partial fin 16 in place when the partial fin 16 is in the deployed position to form the complete fin 18.

In some embodiments, the support 14 may include a clevis 24 that includes a first member 26A and a second side member 26B such that the partial fin 16 rotates between the first side member 26A and the second side member 26B. However, it should be noted that in other embodiments, the support 14 may be other shapes as long as support 14 forms a portion of the complete fin 18 when the partial fin 16 is in the deployed position.

In addition, the support 14 may include a pivot pin 30 that extends through the first side member 26A and the second side member 26B such that the partial fin 16 is rotatably connected to the pivot pin 30. As shown in FIGS. 3 and 5, the clevis 24 may also (i) partially serve to lock the partial fin 16 in place when the partial fin 16 is in the deployed position; and/or (ii) form part of the complete fin 18 when the partial fin 16 is in the deployed position.

In some embodiments, the leaf spring 15 is shaped to form a front to the clevis 24 when the partial fin 16 is in the deployed position (see FIGS. 3 and 5). The leaf spring 15 may snap under the front of the partial fin 16 to lock the partial fin 16 in place as well as form an aerodynamic front edge 20 by closing the front cavity in the clevis 24.

The projectile 10 may further include a deployment mechanism to maneuver the partial fin from the stowed position to the deployed position. The size, shape and style of the deployment mechanism will depend in part on the type of support 14 and partial fin 16 that are utilized on the projectile 10 as well as the application where the projectile 10 is to be used.

Figure 6:
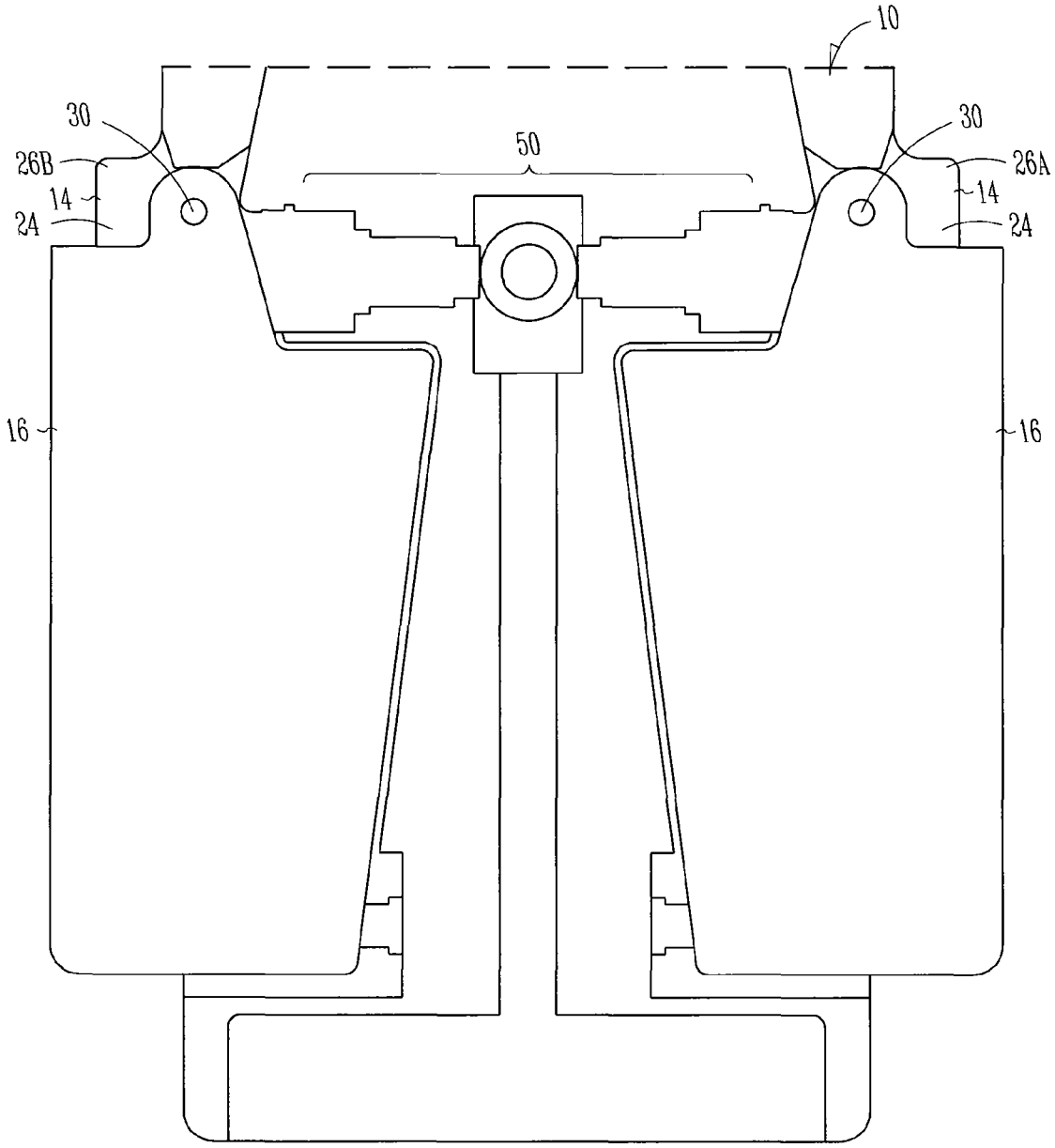
FIG. 6 is a schematic section view illustrating a portion of the projectile shown in FIG. 1 where the partial tail fins are in a stowed position.
Figure 7:
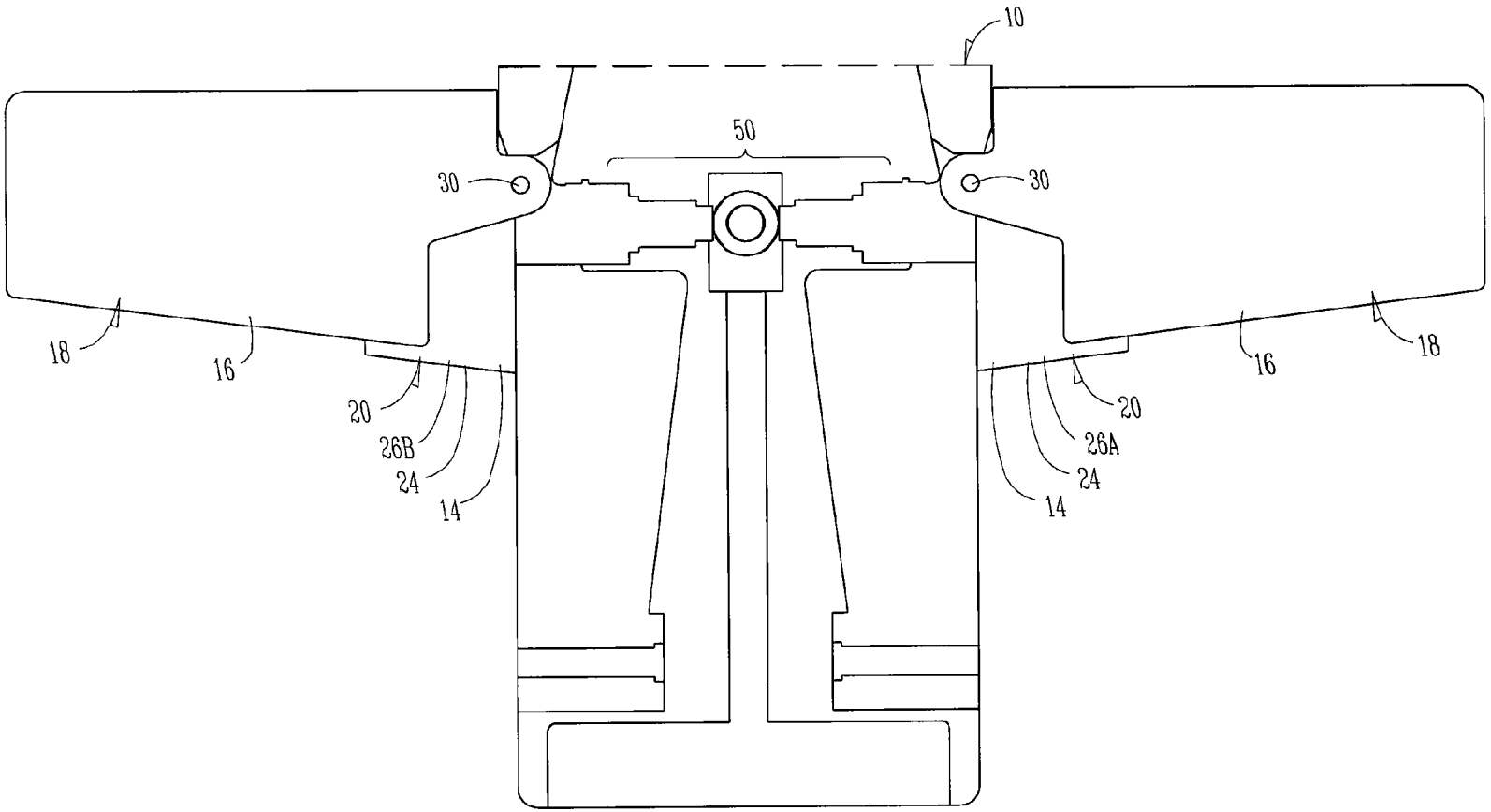
FIG. 7 is a schematic section view similar to FIG. 6 where the partial tail fins are in a deployed position.

As shown in FIGS. 6 and 7, the projectile 10 may further include an adjustment mechanism 50 to maneuver the partial fin 16 and/or support 14 when the partial fin 16 is the deployed position. The size, shape, style and alignment of the adjustment mechanism 50 will depend in part on the type of support 14 and partial fin 16 that are utilized on the projectile 10 as well as the application where the projectile 10 is to be used.

The example projectiles 10 described herein may reduce the aerodynamic drag that is presently induced in existing control fin deployment designs. In addition, the example projectiles 10 described herein may include locking mechanisms that replace existing fin deployment locking mechanisms which tend to malfunction periodically due to wear, ice, or debris (among other factors).

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A projectile comprising:

a body;

a support attached to the body, the support including a leaf spring; and a partial fin rotatably attached to the support such that the partial fin moves between a stowed position and a deployed position, wherein the support moves relative to the partial fin as the partial fin moves between the stowed position and the deployed position such that the partial fin and the support form a complete fin when the partial fin is in the deployed position; and wherein leaf spring that is biased against the fin when the partial fin is in the stowed position, and wherein the leaf spring forms a portion of the front edge of the complete fin when the partial fin is in the deployed position.

2. The projectile of claim 1, wherein the leaf spring locks the partial fin in place when the partial fin is in the deployed position.

3. The projectile of claim 1, wherein the support includes a clevis that includes a first member and a second side member such that the partial fin rotates between the first side member and the second side member, wherein the support further includes a pivot pin that extends through the first side member and the second side member such that the partial fin is rotatably connected to the pivot pin.

4. The projectile of claim 3, wherein the clevis partially locks the partial fin in place when the partial fin is in the deployed position.

5. The projectile of claim 4, wherein the clevis includes the leaf spring that is biased against the fin when the fin is in the stowed position and forms a portion of the front edge of the complete fin when the partial fin is in the deployed position.

6. The projectile of claim 1, further comprising an adjustment mechanism to maneuver the partial fin when the partial fin is the deployed position.

7. The projectile of claim 6, wherein the adjustment mechanism engages the support to maneuver the partial fin when the partial fin is the deployed position.

8. The projectile of claim 7, wherein the adjustment mechanism rotates the support to maneuver the partial fin when the partial fin is the deployed position.

9. The projectile of claim 1, wherein the projectile is a glider.

10. A projectile comprising:

a body;

a support attached to the body, the support including a leaf spring; and a partial fin rotatably attached to the support such that the partial fin moves between a stowed position and a deployed position, wherein the leaf spring moves relative to the partial fin as the partial fin moves between the stowed position and the deployed position, wherein the leaf spring forms a portion of the front edge of the complete fin when the partial fin is in the deployed position and locks the partial fin in place when the partial fin is in the deployed position.

11. The projectile of claim 10, wherein the projectile is a glider.

12. The projectile of claim 10, further comprising an adjustment mechanism that rotates the support to maneuver the partial fin when the partial fin is the deployed position.

* * * * *